US009892820B2

(12) United States Patent
Kodama et al.

(10) Patent No.: US 9,892,820 B2
(45) Date of Patent: Feb. 13, 2018

(54) DIFFERENTIAL SIGNAL TRANSMISSION CABLE HAVING A METAL FOIL SHIELD CONDUCTOR

(71) Applicant: Hitachi Metals, Ltd., Tokyo (JP)

(72) Inventors: Sohei Kodama, Hitachi (JP); Takahiro Sugiyama, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/091,329

(22) Filed: Apr. 5, 2016

(65) Prior Publication Data

US 2016/0300642 A1 Oct. 13, 2016

(30) Foreign Application Priority Data

Apr. 10, 2015 (JP) ..... 2015-081219

(51) Int. Cl.

| | |
|---|---|
| ***H01B 3/30*** | (2006.01) |
| ***H01B 11/20*** | (2006.01) |
| ***H01B 11/18*** | (2006.01) |

(52) U.S. Cl.

CPC ..... *H01B 3/307* (2013.01); *H01B 11/20* (2013.01); *H01B 11/183* (2013.01)

(58) Field of Classification Search

None

See application file for complete search history.

(56) References Cited

U.S. PATENT DOCUMENTS

| | | | | | |
|---|---|---|---|---|---|
| 1,820,204 | A * | 8/1931 | Wilkins | C25D 1/04 | 204/216 |
| 4,319,940 | A * | 3/1982 | Arroyo | H01B 7/295 | 156/185 |
| RE32,225 | E * | 8/1986 | Neuroth | H01B 7/0869 | 174/103 |
| 5,216,202 | A * | 6/1993 | Yoshida | H01B 11/10 | 174/106 R |
| 6,495,759 | B1 * | 12/2002 | Yamamoto | H01B 7/0807 | 174/106 R |
| 8,546,691 | B2 * | 10/2013 | Watanabe | H01B 11/1834 | 174/102 R |
| 8,653,373 | B2 * | 2/2014 | Sugiyama | H01B 11/183 | 174/113 R |
| 8,993,883 | B2 * | 3/2015 | Kumakura | H01B 11/183 | 174/109 |

(Continued)

FOREIGN PATENT DOCUMENTS

| | | |
|---|---|---|
| JP | 2012-133991 A | 7/2012 |
| JP | 2014-038802 A | 2/2014 |
| JP | 2014-078338 A | 5/2014 |

*Primary Examiner* — Chau N Nguyen
*Assistant Examiner* — Muhammed Azam
(74) *Attorney, Agent, or Firm* — Roberts Mlotkowski Safran Cole & Calderon P.C.

(57) ABSTRACT

A differential signal transmission cable includes an insulated wire section including a pair of signal line conductors extending parallel to each other for transmitting a differential signal and an insulation covering the pair of signal line conductors, and a shield conductor including a band-shaped metal foil and spirally wound around the insulate wire section so as to overlap at a portion in a width direction thereof. An allowable elongation of the shield conductor as a stretchable limit in a longitudinal direction without breaking is not less than 2% at normal temperature.

9 Claims, 5 Drawing Sheets

(56) References Cited

U.S. PATENT DOCUMENTS 9,583,235 B2* 2/2017 Nonen ..... H01B 11/085
2002/0003046 A1* 1/2002 Clouet ..... H01B 11/183 174/108
2003/0068517 A1* 4/2003 Andresakis ..... C25D 1/04 428/607
2003/0150633 A1* 8/2003 Hirakawa ..... H01B 11/002 174/36
2009/0229850 A1* 9/2009 Cases ..... H01B 11/20 174/102 R
2011/0083877 A1* 4/2011 Sugiyama ..... H01B 7/0823 174/115
2011/0100682 A1* 5/2011 Nonen ..... H01B 11/203 174/254
2012/0152589 A1* 6/2012 Kumakura ..... H01B 11/20 174/109
2012/0186850 A1* 7/2012 Sugiyama ..... H01B 11/20 174/102 R
2012/0193122 A1* 8/2012 Sugiyama ..... H01B 11/183 174/113 R
2012/0292079 A1* 11/2012 Muramatsu ..... A61B 1/00018 174/113 R
2013/0175081 A1* 7/2013 Watanabe ..... H01B 11/18 174/363
2013/0180752 A1* 7/2013 Kodama ..... H01B 11/1882 174/107
2013/0233589 A1* 9/2013 Kaga ..... H01B 13/06 174/113 R
2013/0333913 A1* 12/2013 Nonen ..... H01B 11/085 174/34
2013/0343713 A1* 12/2013 Hayashishita ..... G02B 6/4434 385/103
2014/0034352 A1* 2/2014 Sugiyama ..... H01B 11/00 174/107
2014/0048302 A1* 2/2014 Nonen ..... H01B 11/02 174/34
2015/0000954 A1* 1/2015 Nonen ..... H01B 11/20 174/103
2015/0021063 A1* 1/2015 Sugiyama ..... H01B 11/002 174/34
2015/0170800 A1* 6/2015 Sugiyama ..... H01B 13/0016 156/56
2015/0371736 A1* 12/2015 Sugiyama ..... H01B 3/30 174/113 R
2016/0111187 A1* 4/2016 Kodama ..... H01B 11/1869 333/5
2016/0300642 A1* 10/2016 Kodama ..... H01B 3/307

* cited by examiner

DIFFERENTIAL SIGNAL TRANSMISSION CABLE HAVING A METAL FOIL SHIELD CONDUCTOR

The present application is based on Japanese patent application No. 2015-081219 filed on Apr. 10, 2015, the entire contents of which are incorporated herein by reference.

BACKGROUND OF THE INVENTION

1. Field of the Invention

The invention relates to a differential signal transmission cable for transmitting a differential signal, and a multi-core differential signal transmission cable that is provided with plural ones of the differential signal differential cable.

2. Description of the Related Art

Differential signal transmission cables with a pair of signal line conductors for transmitting a differential signal are, e.g., used for communication etc. between information processors.

Some of the differential signal transmission cables are modified such that an insulated wire formed by covering the pair of signal line conductors with an insulation is covered by a shield conductor which is specifically designed so as to reduce skew (a difference in propagation time between the pair of signal line conductors) and suck-out (rapid attenuation of signal strength at a specific frequency band) which are problems in high speed transmission of e.g. not less than 10 Gbps (see e.g. JP-A-2012-133991 and JP-A-2014-38802).

JP-A 2012-133991 discloses a differential signal transmission cable that a metal foil tape formed by sticking a metal foil to one side of a plastic tape is used to form the shield conductor. The metal foil tape is folded with the metal foil outside and is then spirally wound around an insulated wire so as to have an overlap at least at a portion of the folded portion formed by folding back.

JP-A-2014-38802 discloses a differential signal transmission cable that a shield tape conductor formed by laminating a conductive metal layer on one surface of a resin layer is used to form a shield conductor and is longitudinally lapped such that a longitudinal direction thereof is parallel to an insulated wire. The shield tape conductor overlaps at both ends in width direction, and first and second resin tapes are wound therearound holding the shield tape conductor.

SUMMARY OF THE INVENTION

The differential signal transmission cable disclosed by JP-A-2012-133991 needs to fold the metal foil tape so that the working process is complicated. The differential signal transmission cable disclosed by JP-A-2014-38802 is configured such that skew or suck-out can be prevented by longitudinally lapping the shield tape conductor. However, due to the shield tape conductor longitudinally lapped, a gap may be formed between the shield tape conductor and the insulated wire and at an overlap of the shield tape conductor when the differential signal transmission cable is bent. The gap may cause a problem that skew becomes likely to occur due to asymmetry in signal propagation characteristics or shielding performance decreases. Thus, the differential signal transmission cables disclosed by JP-A-2012-133991 and JP-A-2014-38802 have room for further improvement in terms of the above problems.

It is an object of the invention to provide a differential signal transmission cable that even when being bent, a gap is less likely to be formed between a shield tape conductor and an insulated wire and at an overlapping portion of the shield tape conductor while preventing the skew or suck-out of signals, as well as a multi-core differential signal transmission cable provided with plural ones of the differential signal transmission cable.

(1) According to an embodiment of the invention, a differential signal transmission cable comprises:

an insulated wire section comprising a pair of signal line conductors extending parallel to each other for transmitting a differential signal and an insulation covering the pair of signal line conductors; and a shield conductor comprising a band-shaped metal foil and spirally wound around the insulate wire section so as to overlap at a portion in a width direction thereof, wherein an allowable elongation of the shield conductor as a stretchable limit in a longitudinal direction without breaking is not less than 2% at normal temperature.

(2) According to another embodiment of the invention, a multi-core differential signal transmission cable comprises a plurality of ones of the differential signal transmission cable according to the above embodiment (1), wherein the plurality of differential signal transmission cables are collectively shielded.

Effects of the Invention

According to an embodiment of the invention, a differential signal transmission cable can be provided that even when being bent, a gap is less likely to be formed between a shield tape conductor and an insulated wire and at an overlapping portion of the shield tape conductor while preventing the skew or suck-out of signals, as well as a multi-core differential signal transmission cable provided with plural ones of the differential signal transmission cable.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiment

Figure 1:
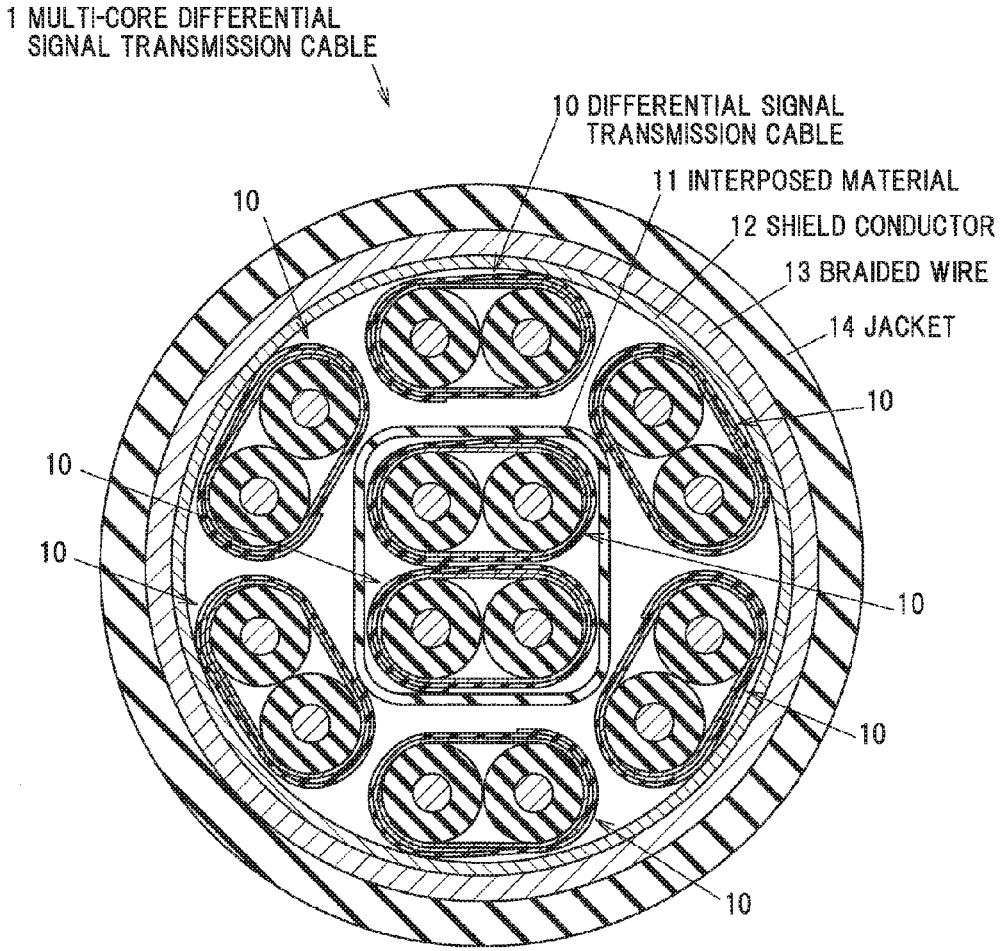
FIG. 1 is a cross sectional view showing a cross sectional structure of a differential signal transmission cable in an embodiment of the present invention and a multi-core differential signal transmission cable provided with plural ones of the differential signal transmission cable.

FIG. 1 is a cross sectional view showing a cross sectional structure of a differential signal transmission cable and a multi-core differential signal transmission cable provided with the differential signal transmission cables in an embodiment of the invention.

A multi-core differential signal transmission cable 1 is configured that plural differential signal transmission cables 10 (eight in the example shown in FIG. 1) are bundled, the plural bundled differential signal transmission cables 10 are shielded all together by a shield conductor 12, the outer periphery of the shield conductor 12 is further covered by a braided wire 13, and the plural differential signal transmission cables 10, the shield conductor 12 and the braided wire 13 are housed in a flexible jacket 14 formed of an insulating material.

In the example shown in FIG. 1, two of the differential signal transmission cables 10 are arranged at the center of the multi-core differential signal transmission cable 1 and these two differential signal transmission cables 10 are housed in a cylindrical interposed material 11 formed of twisted thread or expanded polyolefin, etc. The remaining six differential signal transmission cables 10 are arranged on the outer side of the interposed material 11 at substantially equal intervals.

Configuration of Differential Signal Transmission Cable 10

Figure 2:
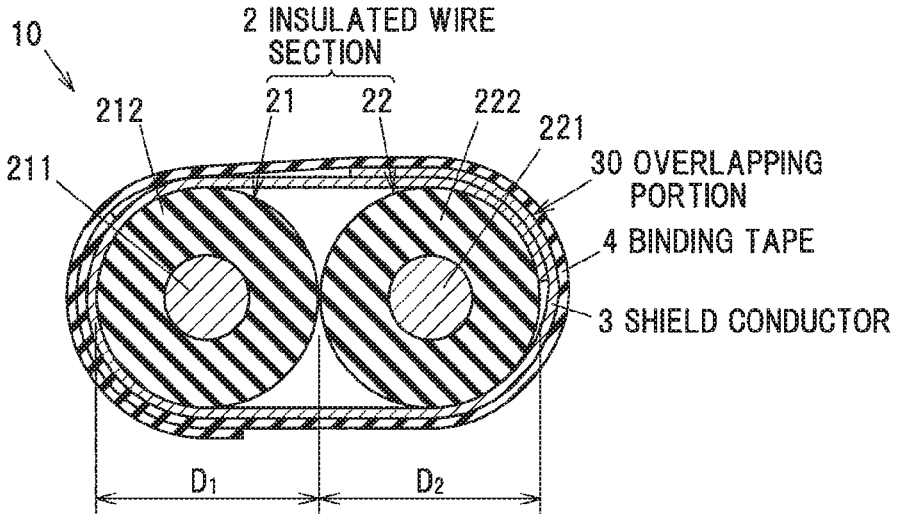
FIG. 2 is a cross sectional view showing a configuration of one differential signal transmission cable.
Figure 3:
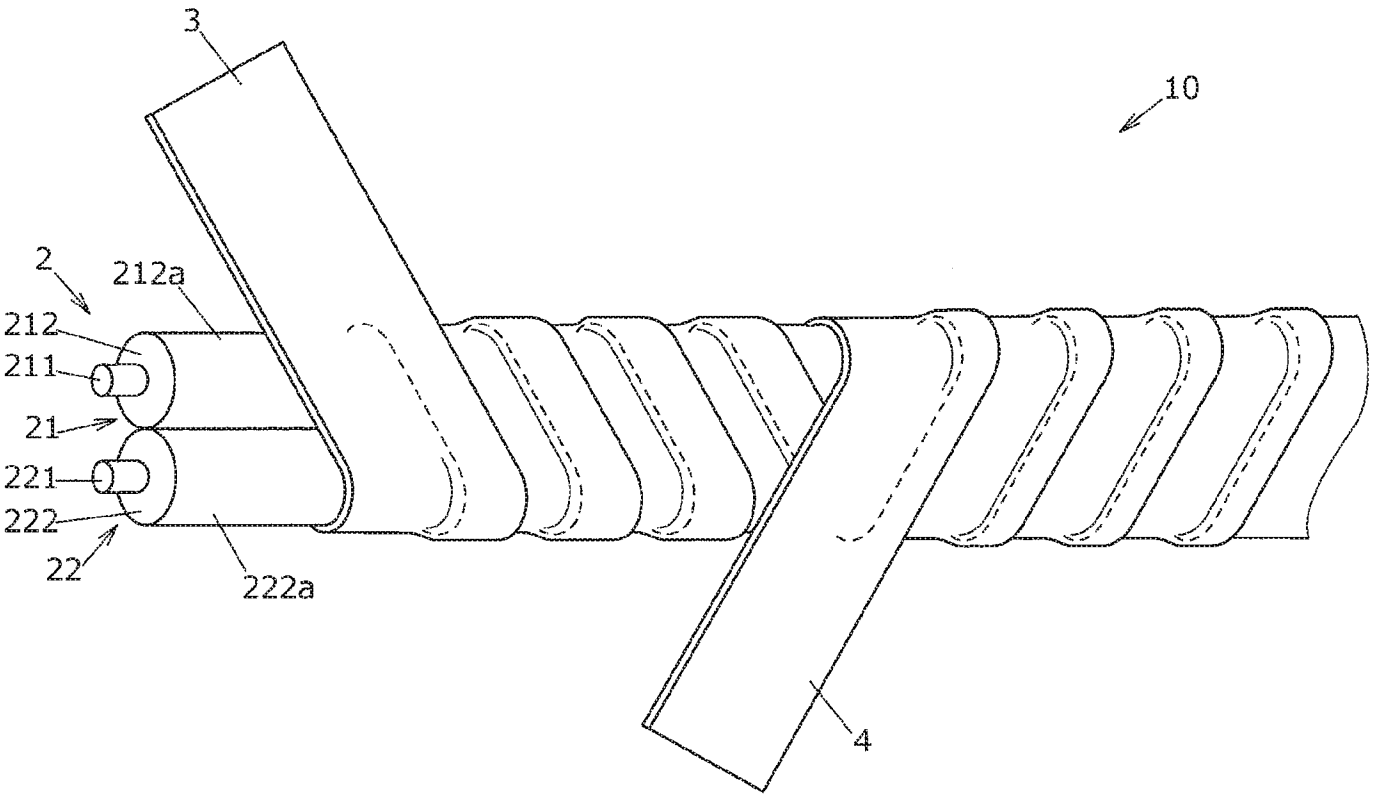
FIG. 3 is a perspective view showing the differential signal transmission cable during the manufacturing process, as viewed in a direction oblique to the extending direction thereof.

FIG. 2 is a cross sectional view showing a configuration of one differential signal transmission cable 10. FIG. 3 is a perspective view showing the differential signal transmission cable 10 during the manufacturing process, as viewed in a direction oblique to the extending direction thereof.

The differential signal transmission cable 10 is provided with an insulated wire section 2 having a pair of signal line conductors 211 and 221 extending parallel to each other and insulations 212 and 222 covering the pair of signal line conductors 211 and 221, a shield conductor 3 formed of a band-shaped metal foil and spirally wound around the insulate wire section 2 so as to overlap at a portion in a width direction, and a binding tape 4 wound around the shield conductor 3 to press the shield conductor 3 against the insulated wire section 2. The shield conductor 3 and the binding tape 4 are spirally wound in opposite directions with a predetermined tensile force. In FIG. 3, a widthwise edge of the shield conductor 3 located on the inner side (the insulate wire section 2 side) of overlap is indicated by a dashed line.

The pair of signal line conductors 211 and 221 transmit a differential pair of signals in a high frequency band of, e.g., not less than 10 Gbps. That is, in communication using the differential signal transmission cable 10, opposite phase signals are output to the pair of signal line conductors 211 and 221 at the sending end and the transmitted signals are combined at the receiving end based on a potential difference between the pair of signal line conductors 211 and 221.

In the present embodiment, the insulated wire section 2 is composed of a first insulated wire 21 and a second insulated wire 22. The first insulated wire 21 is formed by covering the signal line conductor 211 (one of the pair) with the insulation 212 having a circular cross sectional shape. The second insulated wire 22 is formed by covering the signal line conductor 221 (the other of the pair) with the insulation 222 having a circular cross sectional shape.

Each of the signal line conductors 211 and 221 is a solid wire or a twisted wire formed of a highly conductive metal, e.g., copper, etc. The insulations 212 and 222 are formed of, e.g., expanded or non-expanded polyethylene. Alternatively, the insulations 212 and 222 may be formed of expanded Teflon (registered trademark).

Meanwhile, in the present embodiment, the shield conductor 3 is formed of a conductive metal foil consisting mainly of copper (i.e., a copper foil) and does not have a resin layer, etc., for reinforcement. That is, in general, conventional differential signal transmission cables use a shield conductor which has a resin layer formed of a flexible insulating resin such as polyester and a metal layer formed of a highly conductive metal such as copper or aluminum provided on one surface of the resin layer. In contrast, the shield conductor 3 in the present embodiment is formed of only a highly conductive metal. The shield conductor 3 may alternatively be formed of an aluminum foil in place of copper foil.

An allowable elongation of the shield conductor 3, which is a stretchable limit in a longitudinal direction without breaking, is not less than 2% at normal temperature (or ordinary temperature) (e.g., 25C.°). That is, when a tensile stress in the longitudinal direction is applied to the shield conductor 3 at normal temperature, length of a portion elongated by elastic deformation is not less than 2% of the initial length. In addition, the shield conductor 3 has a tensile stress of not more than 300 MPa at an elongation of 1% in the longitudinal direction. The tensile stress here is a result of a tensile test conducted at a tensile rate of 10 mm/sec at normal temperature using Tensilon RTA-500 manufactured by Orientec Co., Ltd.

Such a shield conductor 3 can be obtained by, e.g., rolling a soft copper material to a thickness of not more than 10 μm and then annealing the rolled material to remove internal strain. The thickness of the shield conductor 3 is desirably not less than 7 μm in order to obtain an appropriate electromagnetic shielding effect. In the present embodiment, the shield conductor 3 is formed of a rolled copper foil of not less than 7 μm and not more than 10 μm in thickness. In FIGS. 1 to 3 and FIG. 4 (described later), the thickness of the shield conductor 3 is exaggerated for clear explanation.

The shield conductor 3 may alternatively be formed of an electrolytic copper foil. The electrolytic copper foil is obtained by electrodepositing copper on an electrodeposition drum, and the allowable elongation thereof can be greater than that of the rolled copper foil, and is e.g., not less than 10%.

The shield conductor 3 is spirally wound around the insulated wire section 2 so as to cover the first and second insulated wires 21 and 22 together and to have an overlap of two layers at a portion in a width direction. The binding tape 4 is wound in a direction opposite to the spiral winding direction of the shield conductor 3.

Figure 4A:
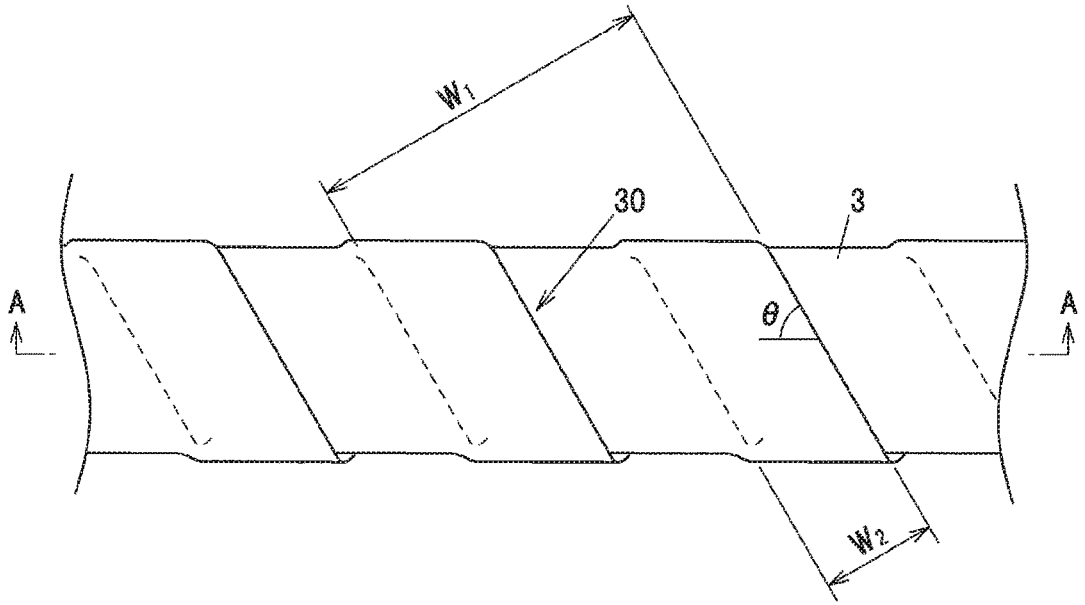
FIG. 4A is a side view showing the differential signal transmission cable when a shield conductor wound around an insulated wire section is viewed in a direction orthogonal to an extending direction of the insulated wire section as well as to an alignment direction of first and second insulated wires.
Figure 4B:
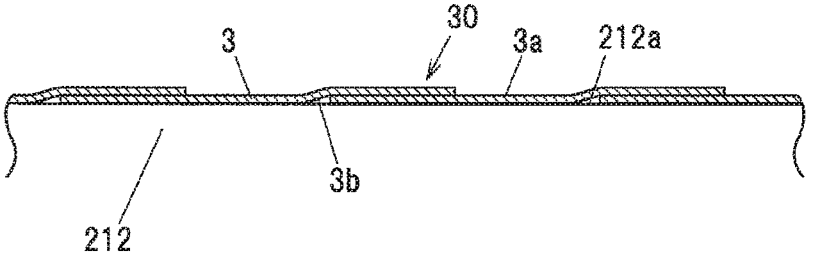
FIG. 4B is a cross sectional view taken along a line A-A in FIG. 4A.

FIG. 4A is a side view showing the differential signal transmission cable 10 when the shield conductor 3 wound around the insulated wire section 2 is viewed in a direction orthogonal to an extending direction of the insulated wire section 2 as well as to an alignment direction of the first and second insulated wires 21 and 22. FIG. 4B is a cross sectional view taken along a line A-A in FIG. 4A. In FIGS. 4A and 4B, the illustration of the binding tape 4 is omitted.

As shown in FIG. 4A, $W_2$ is not less than 30% and less than 50% of $W_1$, where $W_1$ is the entire width of the shield conductor 3 (the entire length in a lateral direction which is orthogonal to the longitudinal direction) and $W_2$ is a width dimension of an overlapping portion 30 at which the shield conductor 3 overlaps itself.

When this percentage is less than 30%, bending the differential signal transmission cable 10 may cause the insulated wire section 2 to partially have a region not covered with the shield conductor 3 and it is not preferable in view of providing sufficient shielding performance. On the other hand, the percentage of not less than 50% is not preferable since the shield conductor 3 is wound in three layers at a portion in the width direction and folds and creases are likely to occur. The reason why folds and creases are likely to occur when the shield conductor 3 is partially wound in three layers, is considered to be due to a level difference in a thickness direction which is increased during winding of the shield conductor 3.

In addition, the shield conductor 3 which is wound in three layers has a three-layer overlap of first to third shield conductors 3 and, at a portion at which a widthwise edge of the second shield conductor 3 located second from the innermost side (the insulated wire section 2 side) is in contact with the third shield conductor 3 located on the outer side, stress is likely to be concentrated and cracks are likely to be generated when, e.g., the differential signal transmission cable 10 is bent. Considering this point of view, the width ($W_2$) of the overlapping portion 30 is desirably less than 50% of the entire width ($W_1$) of the shield conductor 3 so that the shield conductor 3 is not wound in three layers.

As shown in FIG. 4A, when an inclination angle of a winding direction of the shield conductor 3 relative to the extending direction of the pair of signal line conductors 211 and 221 of the insulate wire section 2 is defined as a winding angle θ, the winding angle θ is not less than 30° and not more than 60°. The winding angle θ of less than 30° is not preferable since stress distribution in the shield conductor 3 wound around the insulate wire section 2 varies greatly in a width direction. Meanwhile, the winding angle of more than 60° is also not preferable since the number of turns of the shield conductor 3 per unit length of the insulate wire section 2 increases and it takes longer to manufacture the differential signal transmission cable 10.

In addition, the width ($W_1$) of the shield conductor 3 is desirably not less than 6 times and not more than 8 times the outer diameters $D_1$ and $D_2$ of the first and second insulated wires 21 and 22 (see FIG. 2). In the present embodiment, the outer diameter $D_1$ of the first insulated wire 21 is equal to the outer diameter $D_2$ of the second insulated wire 22.

As shown in FIG. 4B, at the overlapping portion 30 of the shield conductor 3, an outer surface 3*a* and an inner surface 3*b* of the shield conductor 3 are in contact with each other and are electrically conducted. Meanwhile, the inner surface 3*b* of the shield conductor 3 except the portion in the area of the overlapping portion 30 is in contact with outer peripheral surfaces 212*a* and 222*a* of the insulations 212 and 222 of the first and second insulated wires 21 and 22 (see FIG. 3). This allows an electric current to flow linearly through the shield conductor 3 along the extending direction of the pair of signal line conductors 211 and 221 of the insulated wire section 2.

Effects of the Embodiment

In the present embodiment, since the shield conductor 3 formed of a band-shaped metal foil is spirally wound around the insulated wire section 2 so that a portion in a width direction overlaps at the overlapping portion 30, the outer surface 3*a* and the inner surface 3*b* of the shield conductor 3 are in contact with each other at the overlapping portion 30. This allows an electric current to flow through the shield conductor 3 in a direction along the extending direction of the pair of signal line conductors 211 and 221. In detail, in case that a shield conductor formed by, e.g., laminating a resin layer and a metal layer is spirally wound, the flow of electric current is restricted by the resin layer. In contrast, in the present embodiment, such a resin layer is not provided and it is thus possible to exert a sufficient shielding effect.

In addition, although a shield conductor formed of only a single metal foil is likely to be broken when, e.g., a differential signal transmission cable is bent, the shield conductor 3 in the present embodiment is elastically elongated when being bent since the allowable elongation of the shield conductor 3 is not less than 2% at normal temperature and the shield conductor 3 is thereby prevented from being broken.

In addition, since the allowable elongation of the shield conductor 3 is not less than 2% at normal temperature, spirally winding the shield conductor 3 with a predetermined tensile force prevents a gap from being formed between the shield conductor 3 and the insulated wire section 2 and between the shield conductors 3 at the overlapping portion 30. In other words, the shield conductor 3 can be tightly in contact with the outer peripheral surface of the insulated wire section 2 (the outer peripheral surfaces 212*a* and 222*a* of the insulations 212 and 222 of the first and second insulated wires 21 and 22) in a large area and it is thereby possible to prevent skew or suck-out from occurring.

Furthermore, since the binding tape 4 is wound around the shield conductor 3, the shield conductor 3 is pressed against the outer peripheral surface of the insulated wire section 2 by a pressing force of the binding tape 4 and it is thereby possible to more reliably prevent skew or suck-out from occurring.

Modification

Next, a differential signal transmission cable 10A in a modification, which is a modification of the differential signal transmission cable 10, will be described in reference to FIG. 5.

Figure 5:
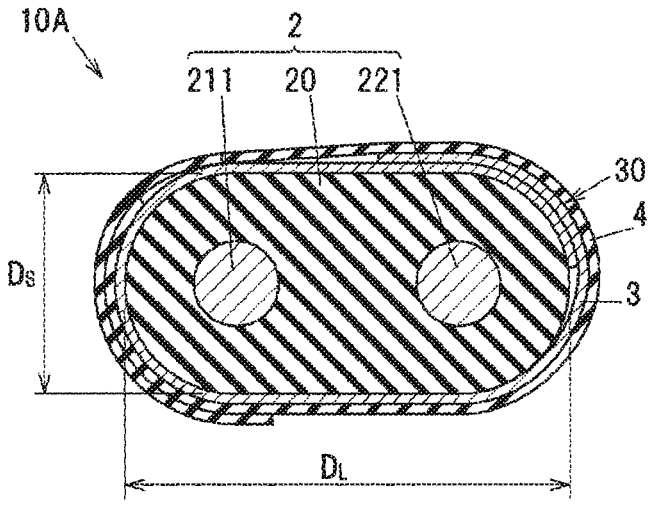
FIG. 5 is cross sectional view showing a differential signal transmission cable in a modification.

FIG. 5 is cross sectional view showing the differential signal transmission cable 10A in the modification. In the differential signal transmission cable 10A, the shield conductor 3 is spirally wound around the insulated wire section 2 so as to overlap at a portion in a width direction and the binding tape 4 is further spirally wound around the shield conductor 3 in the same manner as the differential signal transmission cable 10 described in reference to FIG. 2, etc., but the configuration of the insulated wire section 2 is different from that shown in FIG. 2, etc.

The material, thickness, winding angle θ and entire width $W_1$ of the shield conductor 3 and the width dimension $W_2$ of the overlapping portion 30 are the same as those described in reference to FIG. 4, etc.

The insulated wire section 2 of the differential signal transmission cable 10A in the modification is constructed using an insulated wire formed by covering all the pair of signal line conductors 211 and 221 with an insulation 20. An outer rim of the insulation 20 has an oval shape on a cross section orthogonal to the extending direction of the pair of signal line conductors 211 and 221, as shown in FIG. 5. When the insulation 20 on this cross section has a major axis $D_L$ (a width in an alignment direction of the pair of signal line conductors 211 and 221) and a minor axis $D_S$ (a width in a direction along the perpendicular bisector of the major axis), the width ($W_1$) of the shield conductor 3 is not less than 6 times and not more than 8 times the minor axis $D_S$ of the insulation 20.

The differential signal transmission cable 10A in the modification also achieves the same effects as the embodiment.

Summary Of The Embodiments

Technical ideas understood from the embodiment will be described below citing the reference numerals, etc., used for the embodiment. However, each reference numeral described below is not intended to limit the constituent elements in the claims to the members, etc., specifically described in the embodiment.

[1] A differential signal transmission cable (10, 10A), comprising an insulated wire section (2) comprising a pair of signal line conductors (211, 221) extending parallel to each other for transmitting a differential signal and an insulation(s) (212, 222/20) covering the pair of signal line conductors (211, 221), and a shield conductor (3) comprising a band-shaped metal foil and spirally wound around the insulate wire section (2) so as to overlap at a portion in a width direction, wherein an allowable elongation of the shield conductor (3) as a stretchable limit in a longitudinal direction without breaking is not less than 2% at normal temperature.

[2] The differential signal transmission cable (10, 10A) defined by [1], wherein the shield conductor (3) has a thickness of not less than 7 μm and not more than 10 μm.

[3] The differential signal transmission cable (10, 10A) defined by [1] or [2], wherein the shield conductor (3) has a tensile stress of not more than 300 MPa at an elongation of 1% in a longitudinal direction.

[4] The differential signal transmission cable (10, 10A) defined by any one of [1] to [3], wherein the insulated wire section (2) comprises first and second insulated wires (21, 22), the first insulated wire (21) being formed by covering one (211) of the pair of signal line conductors (211, 221) with an insulation (212) and the second insulated wire (22) being formed by covering the other (221) of the pair of signal line conductors (211, 221) with an insulation (222), and a width of the shield conductor (3) is not less than 6 times and not more than 8 times outer diameters ($D_1$, $D_2$) of the first and second insulated wires (21, 22).

[5] The differential signal transmission cable (10, 10A) defined by any one of [1] to [3], wherein the insulated wire section (2) comprises an insulted wire formed by covering all the pair of signal line conductors (211, 221) with the insulation (20), an outer rim of the insulation (20) has an oval shape on a cross section orthogonal to an extending direction of the pair of signal line conductors (211, 221), and the width of the shield conductor (3) is not less than 6 times and not more than 8 times a minor axis ($D_S$) of the outer rim of the insulation (20) on the cross section.

[6] The differential signal transmission cable (10, 10A) defined by any one of [1] to [5], wherein a width dimension ($W_2$) of the overlapping portion (30) is not less than 30% and less than 50% of the entire width ($W_1$) of the shield conductor (3).

[7] The differential signal transmission cable (10, 10A) defined by any one of [1] to [6], wherein a winding angle (θ) of the shield conductor (3) is not less than 30° and not more than 60°, the winding angle (θ) being an inclination angle of a winding direction of the shield conductor (3) relative to the extending direction of the pair of signal line conductors (211, 221).

[8] The differential signal transmission cable (10, 10A) defined by any one of [1] to [7], further comprising a binding tape (4) that is wound around the shield conductor (3) to press the shield conductor (3) against the insulated wire section.

[9] A multi-core differential signal transmission cable (1), comprising a plurality of ones (10, 10A) of the differential signal transmission cable defined by any one of [1] to [8], wherein the plurality of differential signal transmission cables (10, 10A) are shielded collectively.

Although the embodiment of the invention has been described, the invention according to claims is not to be limited to the embodiment. Further, please note that all combinations of the features described in the embodiment are not necessary to solve the problem of the invention.

What is claimed is:

1. A differential signal transmission cable, comprising:

an insulated wire section comprising a pair of signal line conductors extending parallel to each other for transmitting a differential signal and an insulation covering the pair of signal line conductors;

a shield conductor consisting of a band-shaped single metal foil and spirally wound around the insulate wire section so as to overlap at a portion in a width direction thereof, and a binding tape that is wound around the shield conductor to press the shield conductor against the insulated wire section, wherein the metal foil forming the shield conductor has an allowable elongation of not less than 2% at normal temperature as a stretchable limit in a longitudinal direction without breaking, and wherein the shield conductor is formed from rolling a soft copper material to a thickness of not more than 10 μm and then annealing the rolled material to remove internal strain.

2. The differential signal transmission cable according to claim 1, wherein the shield conductor has a thickness of not less than 7 μm and not more than 10 μm.

3. The differential signal transmission cable according to claim 1, wherein the shield conductor has a tensile stress of not more than 300 MPa at an elongation of 1% in the longitudinal direction.

4. The differential signal transmission cable according to claim 1, wherein the insulated wire section comprises first and second insulated wires, the first insulated wire comprising the insulation covering one of the pair of signal line conductors and the second insulated wire comprising the insulation covering another of the pair of signal line conductors, and wherein a width of the shield conductor is not less than 6 times and not more than 8 times an outer diameter of each of the first and second insulated wires.

5. The differential signal transmission cable according to claim 1, wherein the insulated wire section comprises an insulted wire comprising the insulation collectively covering the pair of signal line conductors, an outer rim of the insulation has an oval shape on a cross section orthogonal to an extending direction of the pair of signal line conductors, and the width of the shield conductor is not less than 6 times and not more than 8 times a minor axis of the outer rim of the insulation on the cross section.

6. The differential signal transmission cable according to claim 1, wherein a width dimension of the overlapping portion is not less than 30% and less than 50% of the entire width of the shield conductor.

7. The differential signal transmission cable according to claim 1, wherein a winding angle of the shield conductor is not less than 30° and not more than 60°, and wherein the winding angle is an inclination angle of a winding direction of the shield conductor relative to the extending direction of the pair of signal line conductors.

8. A multi-core differential signal transmission cable according to claim 1, wherein the shield conductor is formed from rolling a soft copper material to a thickness not less than 7 μm in order to obtain an appropriate electromagnetic shielding effect.

9. A multi-core differential signal transmission cable, comprising a plurality of ones of the differential signal transmission cable according to claim 1, wherein the plurality of differential signal transmission cables are collectively shielded.

* * * * *